United States Patent [19]

Takeda et al.

[11] Patent Number: 5,025,511

[45] Date of Patent: Jun. 25, 1991

[54] HUMAN PRIVATE PARTS WASHING APPARATUS

[75] Inventors: Hisanobu Takeda, Aichi; Tomio Oguma, Anjo, both of Japan

[73] Assignee: Aisin Seiki Kabushiki Kaisha, Kariya, Japan

[21] Appl. No.: 428,633

[22] Filed: Oct. 30, 1989

Related U.S. Application Data

[63] Continuation-in-part of Ser. No. 196,430, May 20, 1988.

[51] Int. Cl.[5] ..... A61H 35/00; A47K 3/22

[52] U.S. Cl. ..... 4/447; 4/444

[58] Field of Search ..... 4/420.1, 420.2, 420.3, 4/420.4, 420.5, 443, 444, 445, 446, 447, 448

[56] References Cited

U.S. PATENT DOCUMENTS 4,551,868 11/1985 Kawai et al. ..... 4/443
4,624,548 12/1986 Kurosawa et al. ..... 4/420.4
4,704,748 11/1987 Takeda et al. ..... 4/420 A

*Primary Examiner*—Henry J. Recla
*Assistant Examiner*—David J. Walczak
*Attorney, Agent, or Firm*—Oblon, Spivak, McClelland, Maier & Neustadt

[57] ABSTRACT

A human private parts washing apparatus is provided with a nozzle supporter, a washing nozzle and a washing water supply tube which extends in the washing nozzle with one end protruding into the washing nozzle. The washing nozzle includes an outer nozzle operated slidably back and forth by a washing nozzle driving device and an inner nozzle operated slidably by the hydraulic pressure of the supplied washing water. An auxiliary washing nozzle driving device operates the washing nozzle over an additional stroke. Thus, the washing water is supplied independent of the washing nozzle's operation positions. The washing nozzle reaches the bidet washing position ahead of the anus region washing position by 30 to 35 mm without any trouble, and the washing nozzle can be advanced and retracted by 10 to 30 mm additionally with respect to the bidet washing position.

8 Claims, 7 Drawing Sheets

HUMAN PRIVATE PARTS WASHING APPARATUS

The present application is a continuation-in-part of U.S. Pat. application Ser. No. 07/196,430, filed on May 20, 1988.

BACKGROUND OF THE INVENTION

1. Field of the Invention

This invention relates to a human private parts washing apparatus installed to a toilet bowl.

2. Discussion of the Background

A washing apparatus disclosed in Japanese Examined Patent Application (KOKOKU) No. 13450/1987 has been known as one of the the washing apparatuses of this type. This conventional washing apparatus will be hereinafter described with reference to FIG. 1. The drawing mainly illustrates a washing nozzle driven by a motor. A nozzle supporter is designated at 10, and installed on the top of a toilet bowl 1 at the rear, and disposed in an enclosure 3. A washing nozzle is designated at 20, and is held in the nozzle supporter 10. The washing nozzle 20 is supported in the nozzle supporting bore 11' slidably back and forth in a forward inclining manner toward the toilet bowl 1 inside.

The washing nozzle 20 has a channel 49 inside thereof, an inlet opening 50 at the rear end thereof and splashing openings 22 on the top at the front end thereof. The nozzle supporter 10 has an annular concave 52 sealed in a water-proof manner with O-rings 51 and connected to a channel 53. The annular concave 52 is formed in the nozzle supporting bore 11', and the channel 53 is connected to a washing water supply source (not shown).

A flexible driving member 131' is fixed to a rotary drum 130 at one end thereof, and to the rear end of the washing nozzle 20 at the other end thereof. The rotary drum 130 is fixed to a motor shaft 33' of a motor (not shown). The flexible driving member 131' is guided in a guide track 132 formed in the nozzle supporter 10, and advances and retracts the washing nozzle 20 in the nozzle supporting bore 11' by a predetermined distance as the motor turns the rotary drum 130. As the flexible driving member 131', a flat spring is proposed in Japanese Examined Patent Application (KOKOKU) No. 13451/1987.

When the splashing openings 22 of the washing nozzle 20 reaches a washing position, the inlet opening 50 communicates with the annular portion 52 to introduce washing water, and washing is performed. In FIG. 1, alternate long and two dashes line "E" shows a contour of a human body when a user sits on a toilet seat. An anus region washing position is designated at "D", and a bidet washing position is designated at "F".

However, the conventional washing apparatus described above has the following problems:

A user cannot adjust the operation positions of the washing nozzle 20 to one's desired positions when the operation positions are not one's desired positions, since the operation positions of the washing nozzle 20 are limited by the position of the annular concave 52 formed in the nozzle supporter 10. In addition, this limitation makes impossible an additional back and forth sliding washing preferable for the bidet washing.

The rotary drum 130 and the washing nozzle 20 are disposed adjacent each other and the guide track 132 is formed with a relatively small radius of curvature in order to make the washing nozzle guide portion compact. Accordingly, especially when the washing nozzle advances, the sliding friction force increases, and the output of the motor must inevitably be great. Here, the sliding force is a resultant force of the sliding friction force exerted between the flat spring and the guide track 132, and the sliding friction force exerted between the washing nozzle 20 and the nozzle supporting bore 11'.

As can be seen from FIG. 7, the washing apparatus 54 cannot have a large dimension in the lateral direction, since a washing water supply tank 55 is provided in the rear. Thus, a sufficient advance and retract stroke is not available for the washing nozzle 20. However, regarding a proper washing, it is preferred to splash the washing water at an elevation angle of 70 deg. with respect to human private parts to be washed. Considering this condition, the anus region washing can be done, but the bidet washing can hardly be done with the conventional washing apparatus. This is because the washing nozzle 20 cannot advance and retract by a sufficient stroke as mentioned earlier, so that the bidet washing cannot be done at a preferred position, i.e., the bidet washing should preferably be done at a position by 30 to 35 mm ahead of the anus region washing position at an elevation angle of 70 deg.

SUMMARY OF THE INVENTION

It is an object of this invention to enable an easy adjustment of the washing nozzle operation positions with a simple arrangement.

A further object of this invention is to solve the improper bidet washing mentioned above by sliding the washing nozzle back and forth over an additional stroke of 10 to 30 mm in the bidet washing position while splashing the washing water.

The above objects have been achieved and any human private parts can be washed satisfactorily at a user's disposal in accordance with this invention:

A new washing water splashing means is devised in this invention. It comprises a nozzle support, a washing nozzle and a washing water supply tube. A major feature of the new washing water splashing means is the washing water supply tube. The washing water supply tube is extending in the washing nozzle in a manner with one end protruding in the washing nozzle, and supplies the washing water to the washing nozzle and makes up the washing nozzle advancement at the same time. Thus, the washing water is supplied independent of the washing nozzle's operation positions through the washing water supply tube.

Further, in this invention, a washing nozzle comprises an outer nozzle operated slidably back and forth with a washing nozzle driving means and an inner nozzle operated slidably with a hydraulic pressure of the supplied washing water in accordance with an instruction from a control means. When an instruction of a washing operation is given by the control means, the washing nozzle driving means is activated to advance the outer nozzle. After the outer nozzle is fully advanced, the inner nozzle is advanced with the hydraulic pressure increased in accordance with an instruction from the control means. Thus, the washing nozzle reaches the anus or bidet washing position by a combined advance of the inner and outer nozzles, and can splash the washing water at the bidet washing position ahead of the anus region washing position by 30 to 35 mm. Here, the outer nozzle advancement is a first-stage advancement of the washing nozzle, and the inner nozzle advancement is a second-stage advancement of the washing nozzle.

Furthermore, in this invention, the washing nozzle, when in the bidet washing position, is operated by an additional stroke by a washing nozzle driving means with an aid of an auxiliary washing nozzle control means. The auxiliary washing nozzle control means may use reed switches or a combination of a cam and snap-action switches. In a preferred embodiment of this invention, a reed switch is disposed on a nozzle support plate at a first position corresponding to the advancement of the outer nozzle to a standby position for the bidet washing, and another reed switch is disposed on the nozzle plate at a second position corresponding to the end of an additional stroke, i.e. a position ahead of the standby bidet washing position by 10 to 30 mm. A magnet is disposed in the outer rim of the washing nozzle adjacent the end thereof and activates the reed switches. Thus, after the first-stage advancement of the washing nozzle is operated with the washing nozzle driving means and the second-stage advancement of the washing nozzle, i.e., the advancement of the inner nozzle to the standby bidet washing position, is operated with the hydraulic pressure of the supplied washing water, the washing nozzle can be advanced and retracted additionally in the bidet washing position slidably over the additional stroke of 10 to 30 mm with the washing nozzle driving means by alternately activating and deactivating the control means via reed switches.

The invention thus constructed offers the following advantages:

The washing water can be supplied independently of the positions of the advancing and retracting washing nozzle, since the washing water is supplied through the washing water supply tube inserted into the washing nozzle. Accordingly, the washing water splashing position can be adjusted easily so that it is possible to make a fine adjustment of the human private parts washing positions depending on where a user sits on the toilet seat.

The radial run-out of the washing nozzle in operation can be prevented, since the washing nozzle is guided with the washing water supply tube.

A longer advancement and retraction stroke is available in a confined space of a washing apparatus when the combination of the outer nozzle operated with the washing nozzle driving means and the inner nozzle operated with the hydraulic pressure of the supplied washing water according to this invention is employed. The longer advancement and retraction stroke has not been available from the conventional washing apparatus. Thus, it is possible to perform the bidet washing efficiently in the direct splashing manner, i.e. at an elevation angle of 70 deg. with respect to human private parts to be washed.

It is possible to perform the bidet washing with back and forth movement over an additional stroke, since the washing nozzle can be operated slidably by an additional stroke when the auxiliary washing nozzle control means according to this invention is employed. Thus, the effect and feeling of the bidet washing is improved.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
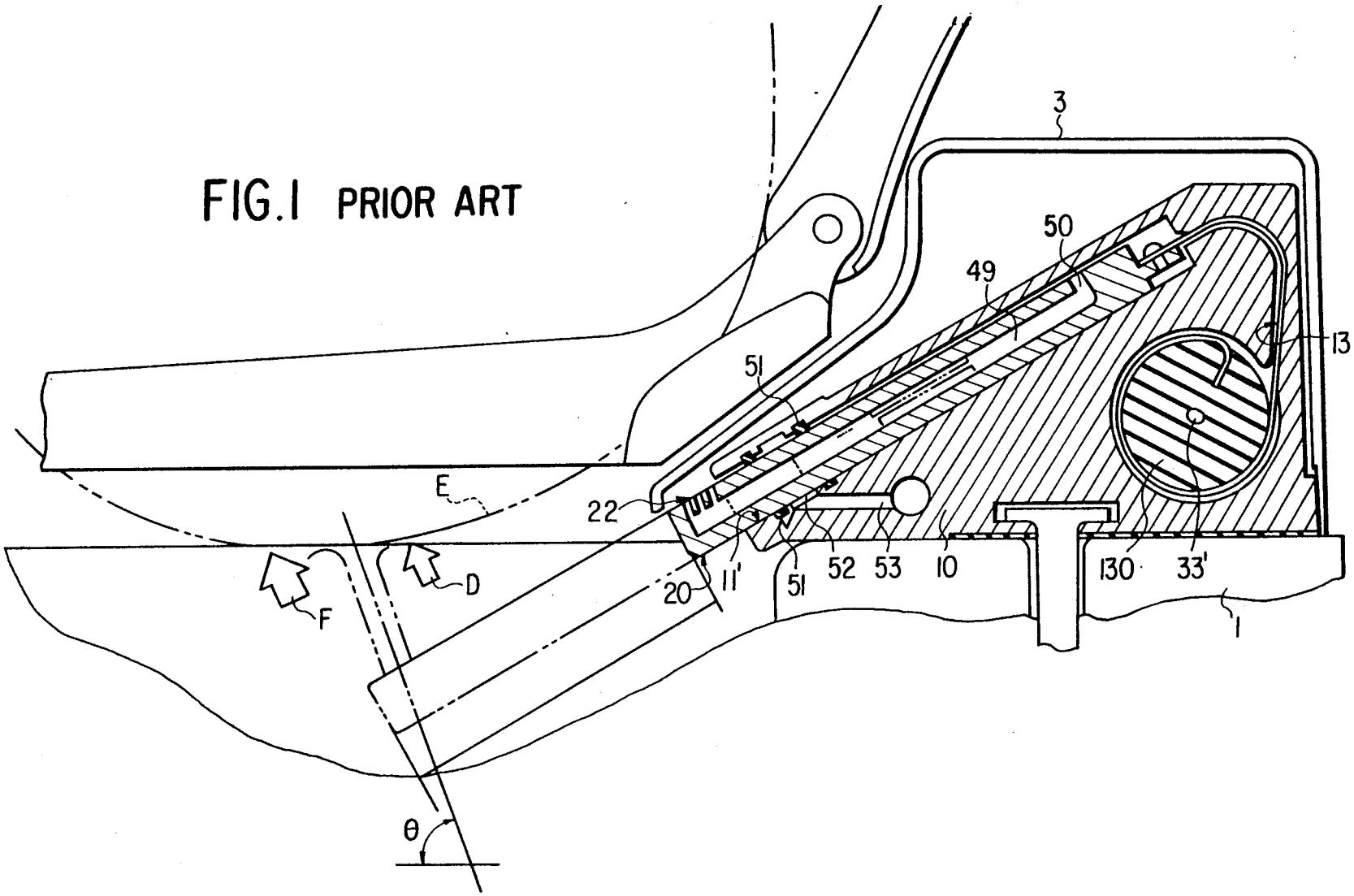
FIG. 1 PRIOR ART
FIG. 1 is a cross sectional view of a conventional apparatus.
Figure 2:
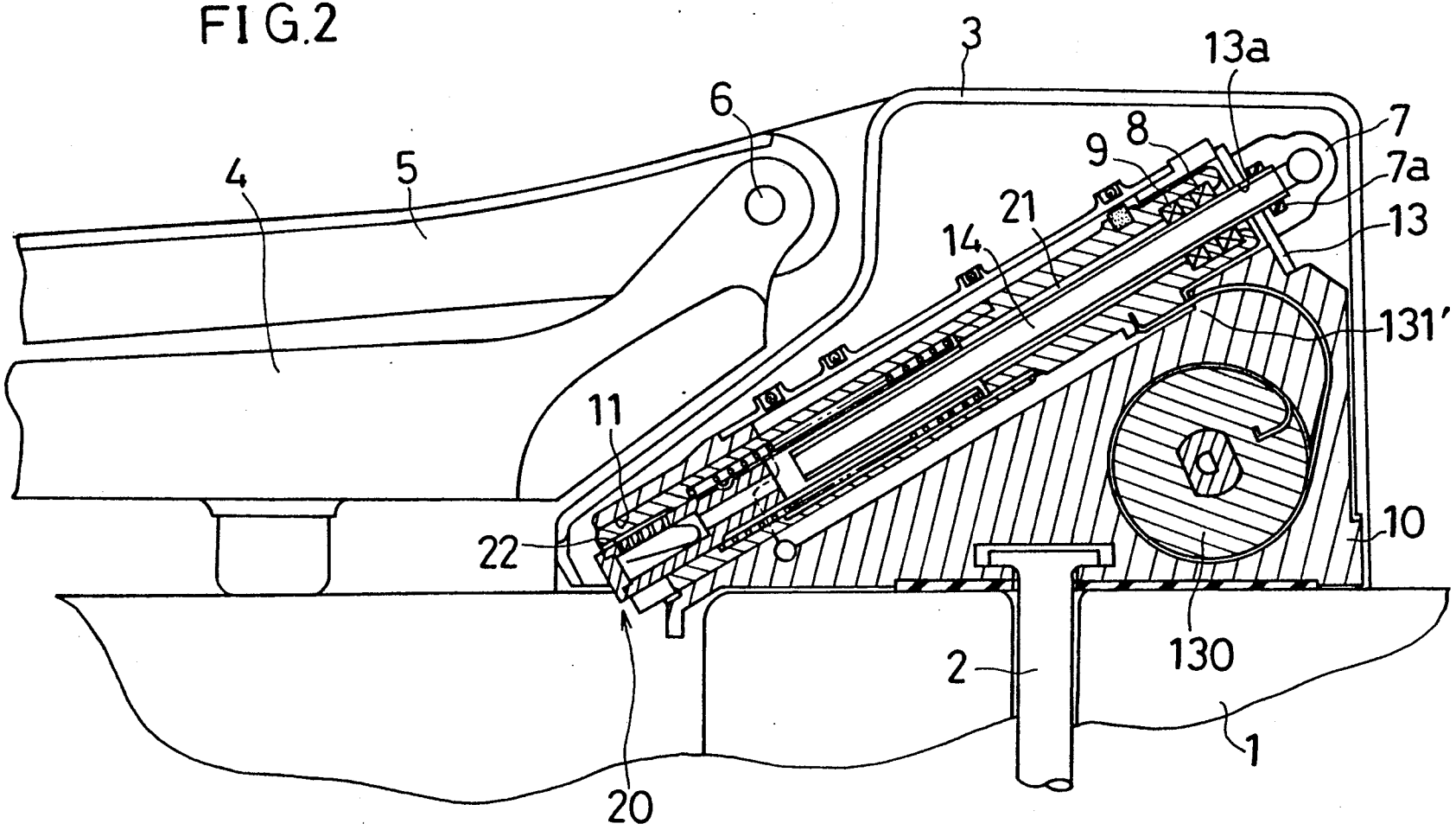
FIG. 2 illustrates a preferred embodiment employing an outer nozzle operated with a washing nozzle driving means and an inner nozzle operated with a hydraulic pressure of the supplied washing water, according to this invention.
Figure 3:
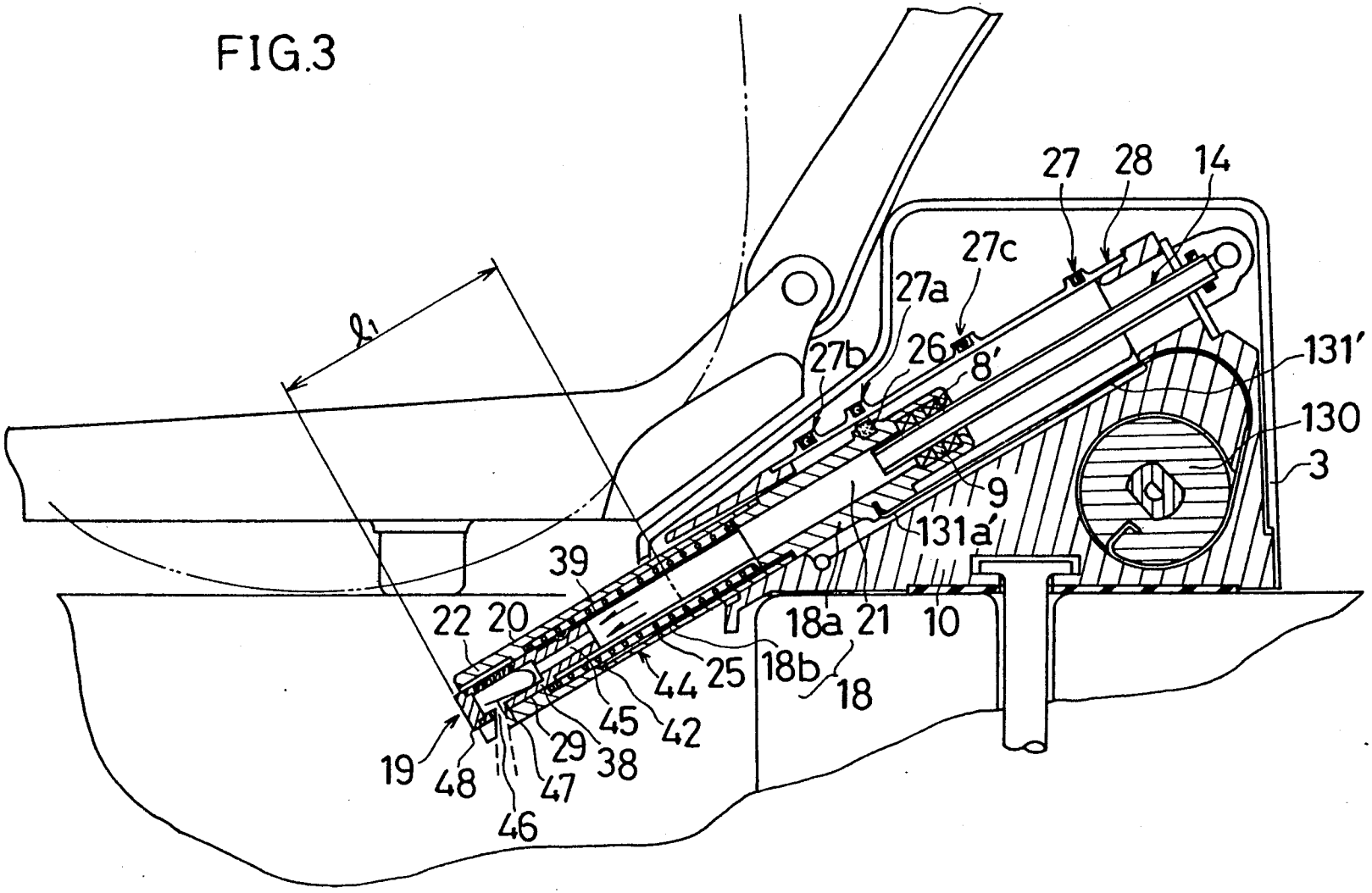
FIG. 3 is a cross sectional view illustrating the washing nozzle operated to its first-stage advancement for the bidet washing.
Figure 4:
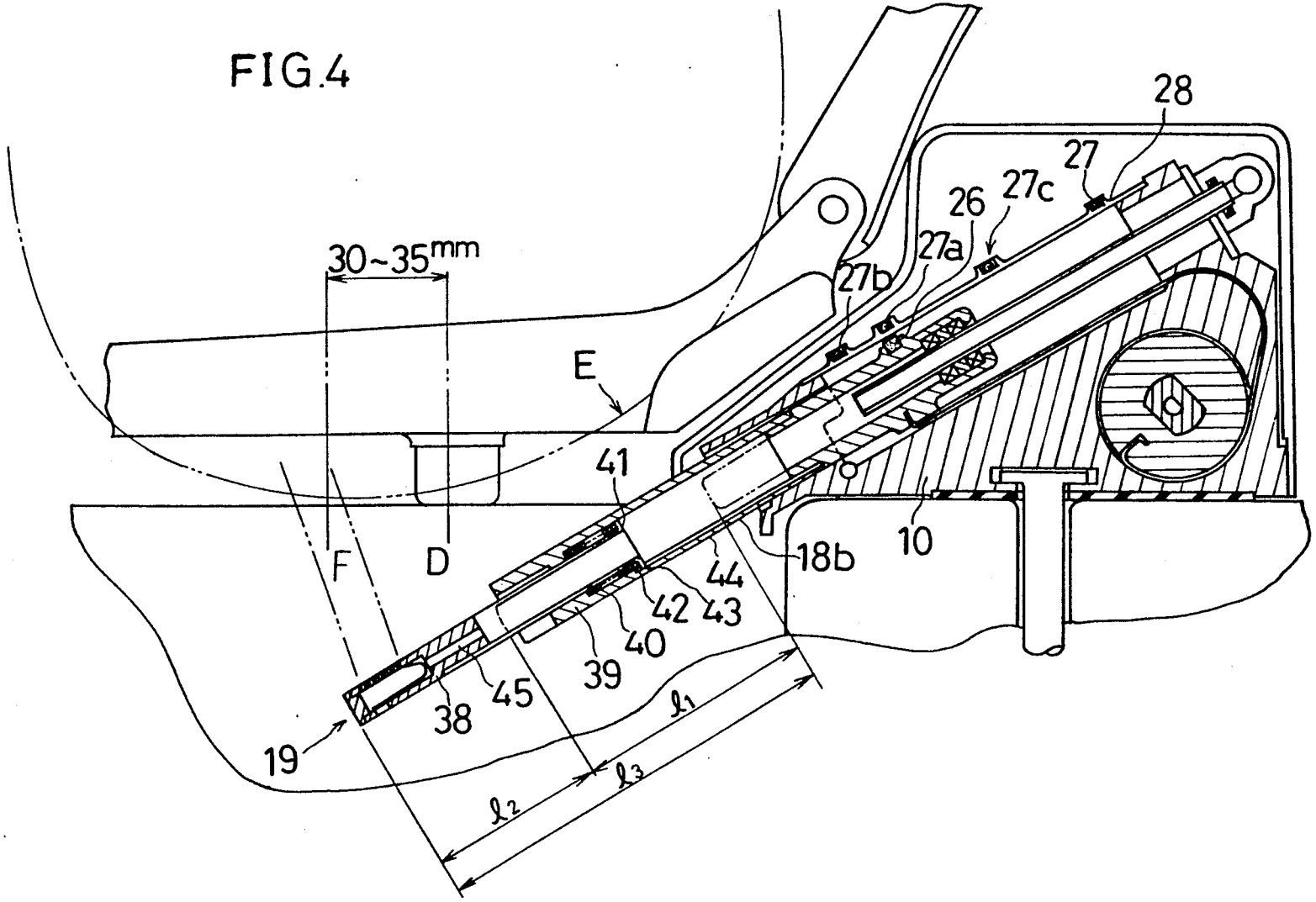
FIG. 4 is a cross sectional view illustrating that the washing nozzle is operated to its second-stage advancement, i.e. the standby bidet washing position.

As illustrated in FIGS. 2 through 4, a nozzle supporter 10 is fixed on the top of a toilet bowl 1 at the rear with a bolt 2. An enclosure 3 having in opening it the front is disposed on the top of the toilet bowl 1, and covers the nozzle supporter 10 in a water-proof manner. The enclosure 3 is provided with a toilet seat 4 and a toilet cover 5 held rotatably with a pin 6.

A nozzle guide bore 11 is formed at the front of the nozzle supporter 10, and is directed in a forward inclining manner toward the inside of the toilet bowl 1. In the nozzle guide bore 11, a washing nozzle 20 is held in a concentric manner with the nozzle guide bore 11, and protrudes out of the opening of the enclosure 3. Thus, the washing nozzle 20 advances and retracts slidably to and from the storage position of FIG. 2 to the human private parts washing positions. A channel 21 closed at one end and having an opening at the other end is formed in the washing nozzle 20. Splashing openings 22 are so formed adjacent the closed end of the channel 21 that they splash the washing water in the directions of human private parts when the washing nozzle 20 is at the operation positions.

A support plate 13 is fixed to the nozzle supporter 10 at the rear with a screw 12. The support plate 13 has a hole **13*a* through which a washing water supply tube 14 is held in a concentric manner with the washing nozzle 20. The washing water supply tube 14 is inserted into the channel 21 of the washing nozzle 20, and has a length sufficient to accommodate the advancement of the washing nozzle 20, depending on the operation positions thereof. The washing water supply tube 14 also works to guide the washing nozzle 20. The washing water supply tube 14 has openings at both ends. One end is disposed in the channel 21, and the other end is fitted with an O-ring 7*a* and joined to a washing water supply pipe 7 communicating with a washing water supply source (not shown) via a valve member 234 shown in FIG. 8**.

A sliding seal 8 is disposed between the washing water supply tube 14 and the washing nozzle 20 to seal between them in a water-proof manner, and fixed on the inner wall of the washing nozzle 20. And a guide ring 9 is fixed on the inner wall of the washing nozzle 20 to maintain the concentricity between the washing water supply tube 14 and the washing nozzle 20 while the washing nozzle 20 is operating. The sliding seal 8 decreases the frictional resistance between the washing water supply tube 14 and the washing nozzle 20 when the washing nozzle 20 slides. Consequently, it is possible to produce the washing nozzle 20 with less cost but with a wide variety of appearances, since no treatment is required to reduce the frictional resistance of the washing nozzle 20 outer surface.

Figure 8:
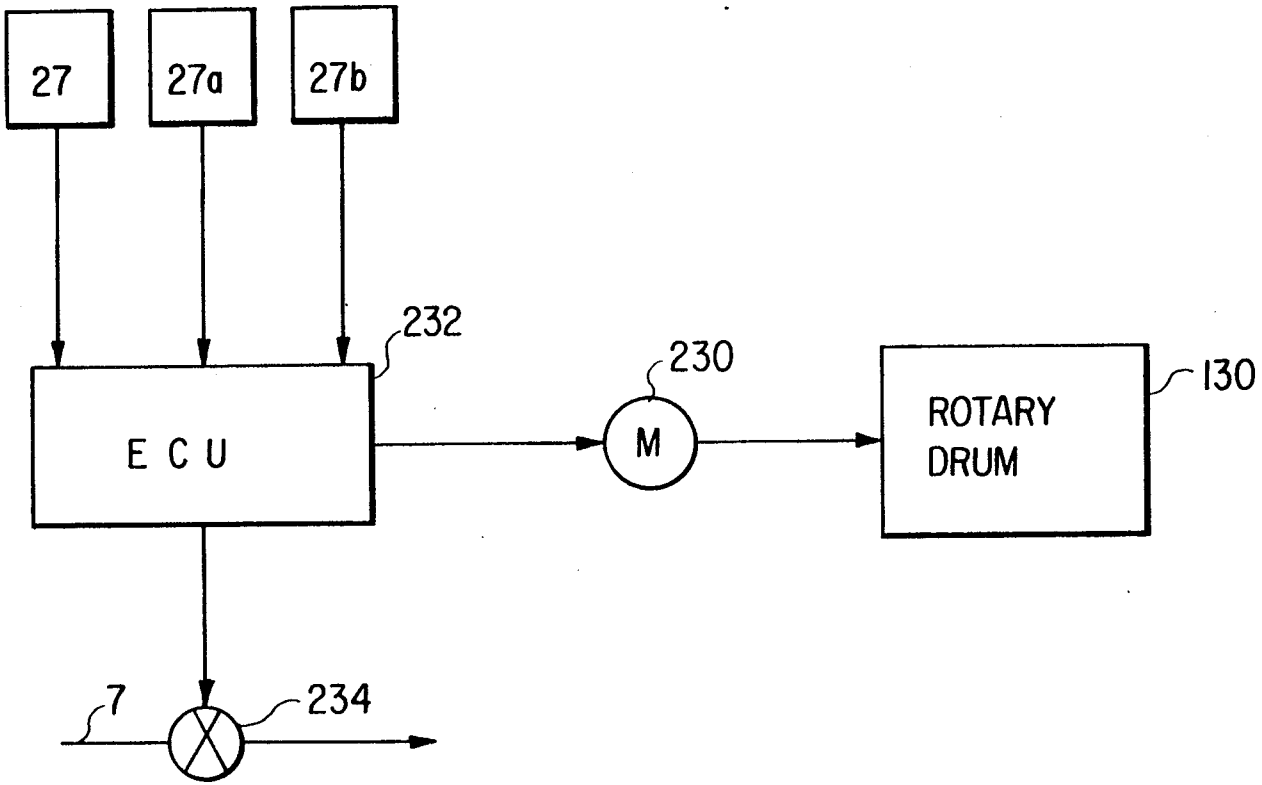
FIG. 8 schematically shows a control means.

The washing nozzle 20 is advanced and retracted by a drive system including a rotary drum 130 having attached thereto a flexible driving member such as a cable or flat spring 131', similar to that shown in Japanese Examined Patent Application No. 13451/1987. Referring to FIG. 8, the rotary drum 130 is driven by a motor 230, which is in turn controlled by a motor control means including an electronic control unit (ECU) 232. The ECU can be of a conventional design, including a processor and memory, and programmable to operate the motor to move the rotary drum according to a predetermined or programmed sequence.

FIG. 2 shows the washing nozzle 20 stored in a storage position. It can be advanced from the storage position by rotation of the rotary drum 130 for movement to an anus washing position (designated at "D" in FIG. 4), a bidet standby position, or any other desired position, as will be described below.

Turning now to FIG. 3, the figure shows that the washing nozzle 20 is at the first-stage advancement, i.e. advanced by a stroke of l1 by rotation of the rotary drum 130. When an instruction of washing operation is given through the motor control means generally shown in FIG. 8, the washing nozzle 20 is advanced in a forward inclining manner as the cable 131' extends in accordance with the rotary drum 130 turned with the motor. In this case, the stroke l1 is to a bidet washing standby position. For anus washing, the washing nozzle 20 is advanced by a stroke which is shorter than the stroke l1 by 30 mm–35 mm. The washing nozzle 20 is thus positioned at an anus washing standby position which is in the rear of the bidet washing standby position illustrated in FIG. 3 by 30 mm–35 mm.

The washing nozzle 20 includes an outer nozzle 18 and an inner nozzle 19. The outer nozzle 18 includes a rear member **18*a* and a front member 18*b* joined together. The channel 21 and a spring chamber 25, having a larger inner diameter than the channel 21, are formed respectively in the rear member 18*a* and the front member 18*b*. The sealing members 8 and the guide ring 9 are fixed on the inner wall of the rear member 18*a* at the rear end thereof. Further a magnet 26 and the one end 131*a'* of the cable 131' are fixed on the outer wall of the rear member 18*a* adjacent the rear end. The front member 18*b* has an opening at the front end, and the outer wall of the inner nozzle 19 moves slidably back and forth in the inner wall of the front member 18*b***.

The inner nozzle 19 includes a nozzle head 38 and a cylinder 39 joined together. The cylinder 39 terminates in a flange 41 which presses on a spring 40 in the spring chamber 25. A reduced diameter channel 45 is formed in the inner nozzle 19 to maintain the inner hydraulic pressure in the channel 21 for pushing the inner nozzle 19 forward while the pressure of the supplied washing water is increasing.

For discharging the residual washing water when the washing apparatus is not used, the inner nozzle has a discharge opening 46. A normally open, leaf spring type poppet member 47 is disposed in the inner nozzle 19 and closes the discharge opening 46 only in response to increased pressure of the supplied washing water, in order to permit discharge of the cold residual water and to minimize the washing water leakage. If desired, the reduced diameter channel 45 and the poppet member 47 may be replaced with a valve. The splashing openings 22 are so formed in the inner nozzle 19 that they direct the washing water to the human private parts when the washing nozzle 20 is in operation. The inner nozzle 19 is plugged with a plug 48.

Thus, when the ECU 232 opens the valve member 234, as the pressure of the supplied washing water increases, the water pressure closes the poppet member 47 and the inner nozzle 19 advances by a stroke of l2 against the force of the return spring 40 from the first stage position illustrated in FIG. 3 to the second stage advancement position illustrated in FIG. 4, e.g. in the bidet washing position the washing water is splashed by 30 to 35 mm ahead of the anus region washing position designated at "D". Of course, for anus washing the inner nozzle 19 also advances by the stroke of l2 while the outer nozzle 18 of the washing nozzle 20 is placed at the anus washing standby position, namely in the rear of the bidet washing standby position illustrated in FIG. 3 by 30 mm–35 mm. Thus, an overall stroke of the washing nozzle 20 for anus washing is shorter than the stroke l3 by 30 mm–35 mm, and accordingly the washing water is splashed at the anus washing position designated at "D" in FIG. 4.

In the state illustrated in FIG. 4, the return spring 40 is fully pressed to minimize the clearance between a flange 41 of the cylinder 39 of the inner nozzle 19 and the shoulder 42 of the front member **18*b* of the outer nozzle 18 and avoid washing water leakage through the clearance. The flange 41 has a projection 43 on the outer rim. The projection 43 slidably engages a slide track 44 formed in the front member 18*b*, and works to prevent rotation of the nozzle head 38**.

Further, auxiliary washing nozzle control means include reed switches designated at 27, **27*a* 27*b* and 27*c* and disposed on a nozzle support plate 28 over the nozzle supporter 10. They are provided to detect, and supply to the ECU, the positions of the washing nozzle 20 via the positions of the magnet, 26. The positions of the reed switches 27, 27*a*, 27*c* and 27*b* respectively correspond the storage position of the washing nozzle, the first-stage or second stage advancement of the washing nozzle 20, i.e. the advancement of the outer nozzle 18** to a standby position for bidet or anus washing, and the end of an additional stroke l4 later described.

Figure 5:
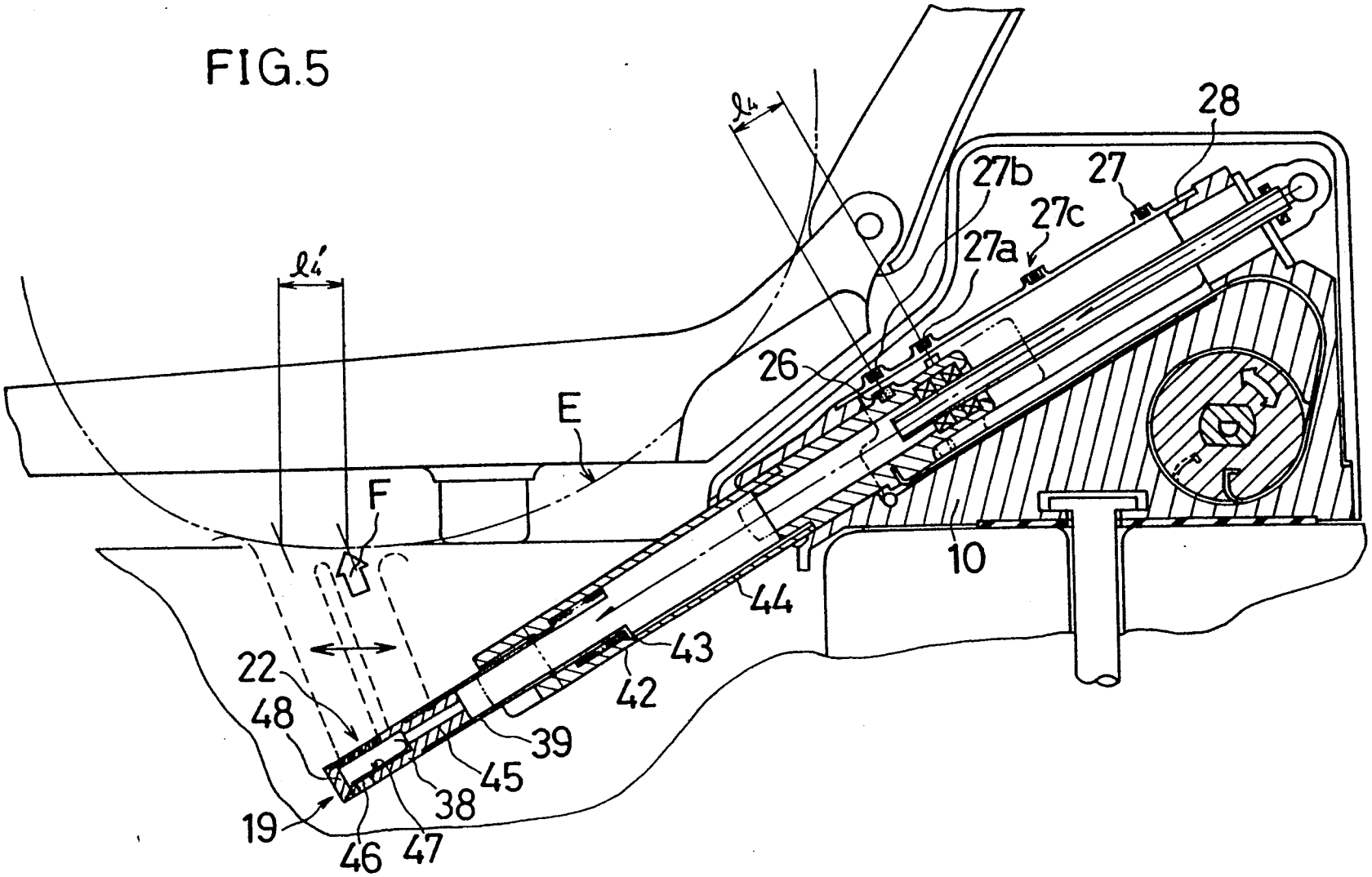
FIG. 5 is a cross sectional view illustrating that the washing nozzle advanced over an additional stroke with respect to the second-stage advancement for the bidet washing position.
Figure 6:
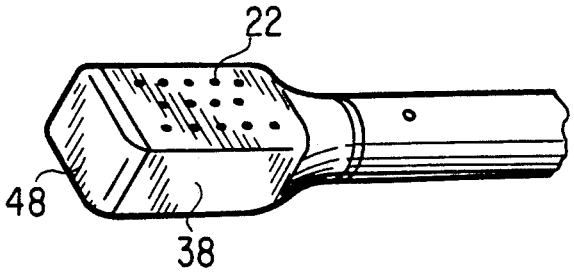
FIG. 6 is a view illustrating an appearance of the washing nozzle front end.
Figure 7:
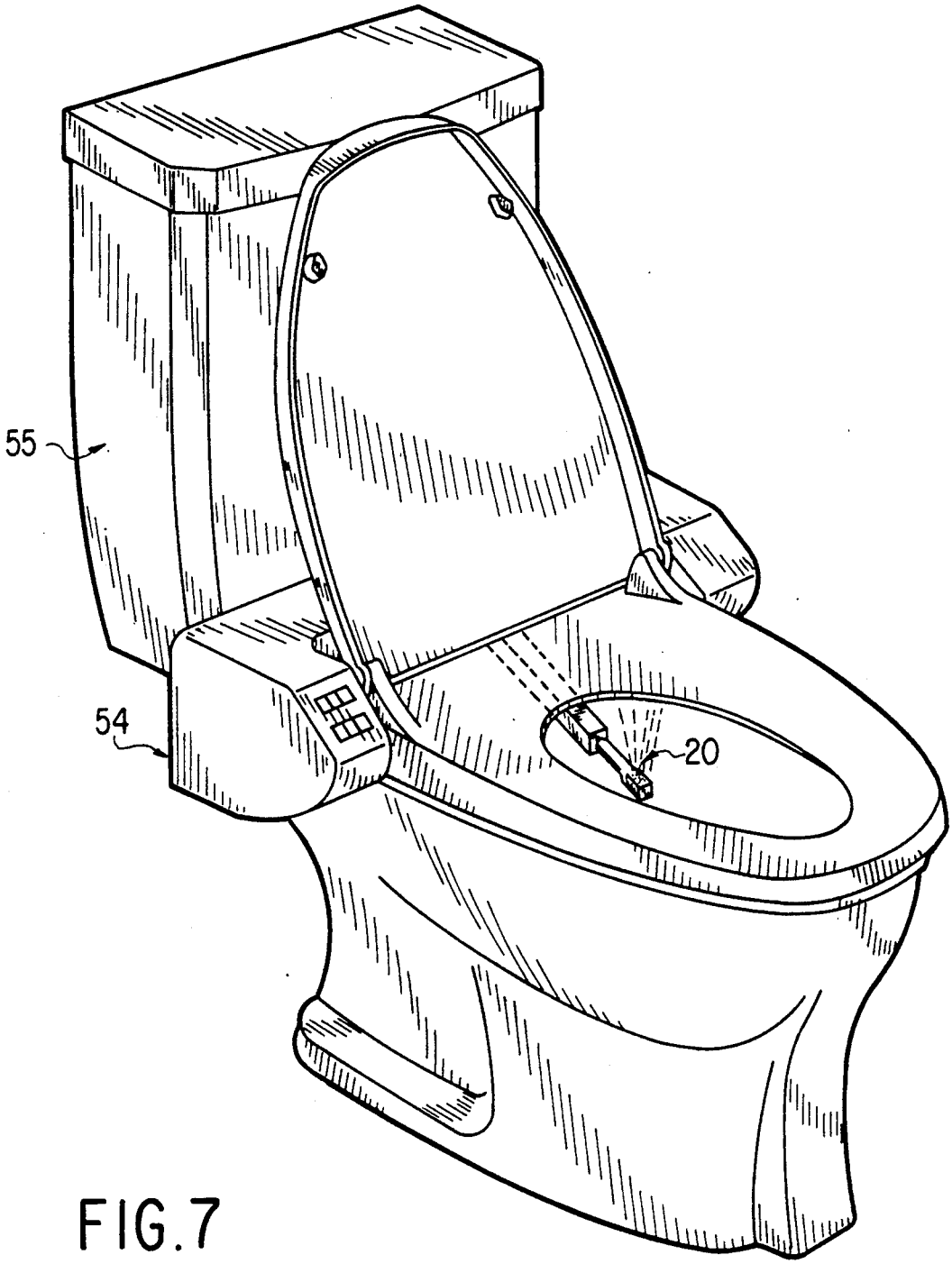
FIG. 7 is a view illustrating an appearance of a toilet bowl with a human private parts washing apparatus installed.

Turning now to FIG. 5, the drawing illustrates that the washing nozzle 20 is operated to slide back and forth additionally with respect to the bidet washing standby position. The washing nozzle 20 is advanced and retracted slidably by the washing nozzle driving means, by activating and deactivating the auxiliary control means via the reed switches **27*a* and 27*b*, by a stroke of l4 with respect to the bidet washing standby position. Here, the positions of the reed switches 27*a* and 27*b* correspond the first-stage (or second-stage) advancement of the washing nozzle 20, i.e. the advancement of the outer nozzle 18 to a standby position for the bidet washing, and the end of the additional stroke respectively. Thus, the bidet washing with back and forth movement can be done over the additional stroke 14 by operating the washing nozzle 20 between the positions of the reed switches 27***a* and 27*b* in a certain period of time, and the feeling of the bidet washing can be improved.

What is claimed as new and desired to be secured by Letters patent of the United States is:

1. A human private parts washing apparatus adapted to be installed on the top of a toilet bowl at the rear, comprising:

a washing water splashing means for splashing washing water to human private parts, said washing water splashing means including a nozzle supporter, and a washing nozzle supported by said nozzle supporter, said washing nozzle being slidably held in an obliquely declining manner and being directed toward an inside of said toilet bowl, said washing nozzle including an outer nozzle, mechanical driving means for slidably operating said outer nozzle back and forth from a storage position to at least one washing standby position, and an inner nozzle having splashing openings and being slidably stored inside said outer nozzle at a front side thereof, said inner nozzle having an orifice communicating said splashing openings and the interior of said outer nozzle, and washing water hydraulic pressure means for slidably operating said inner nozzle back and forth from said at least one standby position to at least one operating position;

a washing water supplying means for supplying washing water from a washing water supply source; and a control means for providing operation instructions to said washing water splashing means and said washing water supplying means so as to operate said outer nozzle back and forth from said storage position to said at least one standby position via said mechanical driving means, so as to supply washing water from said washing supply source into said washing nozzle via said washing water supplying means, so as to operate said inner nozzle back and forth from said at least one standby position to said at least one operating position via said hydraulic pressure means, and so as to wash human private parts.

2. A human private parts washing apparatus according to claim 1, wherein said mechanical driving means comprises, for operating said outer nozzle slidably back and forth between said storage position and said standby positions;

a rotary drum; and a cable disposed in a guide track, fixed at one end to said washing nozzle adjacent an end thereof, fixed at an other end to said rotary drum and wound around said rotary drum.

3. A human private parts washing apparatus according to claim 1 including an auxiliary washing nozzle control means for reciprocating said nozzle by an additional stroke when said nozzle is in one of said at least one operating positions.

4. A human private parts washing apparatus according to claim 3 wherein said auxiliary washing nozzle control means comprise:

sensing means for sensing a position of said washing nozzle at one of said operating position and at said additional stroke; and means for operating said mechanical driving means in response to said signals from said sensing means.

5. A human private parts washing apparatus according to claim 4 wherein said at least one standby position comprises one of an anus washing standby position and a bidet washing standby position, and wherein said at least one operating position comprises one of as anus washing position and a bidet washing position.

6. A human provide parts washing apparatus according to claim 4 wherein said one of said operating positions comprises a bidet washing position.

7. A human private parts washing apparatus according to claim 4 wherein said sensing means comprise reed switches mounted on said nozzle supporter and facing a magnet mounted to said washing nozzle.

8. A human private parts washing apparatus according to claim 1 wherein said at least one standby position comprises one of an anus washing standby position and a bidet washing standby position, and wherein said at least one operating position comprises one of an anus washing position and a bidet washing position.

* * * * *